US006607012B2

(12) United States Patent
Yquel

(10) Patent No.: US 6,607,012 B2
(45) Date of Patent: Aug. 19, 2003

(54) SYSTEM COMPRISING BOTH A RECEPTACLE AND APPARATUS ENABLING IT TO BE FILLED WITH COMPRESSED AIR

(75) Inventor: Jean-Pierre Yquel, Colombes (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/736,155

(22) Filed: Dec. 15, 2000

(65) Prior Publication Data

US 2001/0013379 A1 Aug. 16, 2001

(30) Foreign Application Priority Data

Dec. 22, 1999 (FR) ..... 99 16256

(51) Int. Cl.[7] ..... B65B 1/04; B67D 5/42

(52) U.S. Cl. ..... 141/20; 141/3; 141/113; 222/386.5

(58) Field of Search ..... 141/3, 20, 113; 222/386.5, 395; 137/223

(56) References Cited

U.S. PATENT DOCUMENTS 3,124,917 A * 3/1964 Dobbins ..... 141/20
3,169,670 A * 2/1965 Hrebenak et al.
3,406,877 A * 10/1968 Frangos
3,422,837 A * 1/1969 Boyer et al.
3,451,592 A * 6/1969 Bartels ..... 141/20
3,572,402 A * 3/1971 Beffel
3,654,743 A * 4/1972 McGeary ..... 141/20
3,748,818 A 7/1973 Rousseau
4,197,884 A 4/1980 Maran
4,709,734 A * 12/1987 Rudick et al. ..... 222/386.5
4,877,065 A * 10/1989 Lamboy et al.
5,092,750 A * 3/1992 Leroy et al. ..... 141/20
5,203,383 A * 4/1993 Turunen
5,343,904 A 9/1994 Kaeser
5,411,183 A * 5/1995 Hildebrandt ..... 141/18
5,462,099 A * 10/1995 Demarest et al.

FOREIGN PATENT DOCUMENTS

WO WO 91/01257 2/1991
WO WO 94/03380 2/1994

* cited by examiner

*Primary Examiner*—Gregory L. Huson
*Assistant Examiner*—Khoa Huynh
(74) *Attorney, Agent, or Firm*—Oliff & Berridge, PLC

(57) ABSTRACT

A system for dispensing a liquid comprises a receptacle and apparatus for refilling the receptacle with compressed air, the receptacle being provided with a filling valve. The liquid to be dispensed and the air under pressure are contained inside the receptacle separately in different spaces.

48 Claims, 4 Drawing Sheets

SYSTEM COMPRISING BOTH A RECEPTACLE AND APPARATUS ENABLING IT TO BE FILLED WITH COMPRESSED AIR

The present invention relates to a system for dispensing a liquid, the system comprising both a receptacle and apparatus for refilling the receptacle with compressed air, the bottom of the receptacle being provided with a filling valve.

BACKGROUND OF THE INVENTION

Attempts are being made at present to replace aerosol receptacles that contain a propellant gas constituted by a liquefied gas, with aerosol receptacles using compressed air as the propellant gas.

The use of compressed air raises a problem of independence if it is desired to maintain constant quality, and it turns out to be necessary to refill the receptacle several times in order to be able to dispense in satisfactory manner all of the liquid contained in the receptacle, the propellant gas being dispensed together with the liquid.

International patent application WO 94/03380 discloses a system for dispensing a liquid, the system comprising both a receptacle provided with a filling valve and apparatus enabling the receptacle to be refilled with compressed air.

The filling valve is connected to a tube that emerges above the surface of the liquid, so as to avoid producing a foam inside the receptacle when the receptacle is refilled with compressed air.

The filling valve is also relatively complex since it must be capable of providing sealing not only for compressed air but also for the liquid contained in the receptacle.

International patent application WO 91/01257 discloses a system of the same type as that described in application WO 94/03380, the filling valve being preferably fitted with a tube that emerges above the surface of the liquid. The filling valve preferably has a first gasket which opens when a filling endpiece is inserted, and a second gasket which opens under the pressure of air escaping from the filling endpiece, and it presents a structure that is relatively complex.

U.S. Pat. No. 5,343,904 discloses a system similar to those described in the above-mentioned international applications, in which the filling valve has a ball and a O-ring. The filling endpiece has a diameter that is relatively large and carries an O-ring. A relatively complex lever mechanism engages the filling valve during filling, in order to prevent the receptacle from moving.

OBJECTS AND SUMMARY OF THE INVENTION

The invention seeks in particular to remedy all or part of the drawbacks of known dispensing systems, and in particular seeks to propose a system of structure that is relatively simple and that operates reliably.

The novel system of the invention comprises both a receptacle and apparatus for refilling the receptacle with compressed air, the receptacle being provided with a filling valve, wherein the fluid to be dispensed and the air under pressure are contained inside the receptacle in separate manner in different spaces.

By means of the invention, it is possible to use a filling valve which is relatively simple in structure since it does not come into contact with the liquid.

In addition, it does not need to be connected to a tube since there is no risk of foaming occurring while the receptacle is being filled with gas.

Preferably, the fluid is a liquid contained in a flexible bag inside the receptacle.

Also preferably, the receptacle is provided with a valve enabling the liquid to be dispensed, said valve having at least three functionally different positions, namely: a rest position; a position enabling air to be dispensed on its own; and a position enabling a mixture of air and liquid to be dispensed.

Also preferably, the filling valve is made solely out of elastomer, preferably by molding a single piece.

The valve then preferably presents a structure that is less complex than the filling valves of known dispensing systems, as mentioned above.

The apparatus enabling the receptacle to be refilled with compressed air advantageously comprises a compressor and an endpiece connected to the outlet of the compressor and arranged to engage in the valve of the receptacle.

Preferably, the apparatus enabling the receptacle to be refilled with compressed air includes a moving member provided with a passage for the endpiece, the moving member and the endpiece being arranged in such a manner that the endpiece engages in the valve of the receptacle in response to the moving member being pushed down.

Preferably, for a filling valve having an end wall, the length of the endpiece is selected so that it does not reach the end wall of the filling valve when the moving member is pushed down, the endpiece being engaged over only two-thirds of the length of the valve, for example.

Preferably, the endpiece remains engaged in the moving member whatever the position of the moving member, and in particular in the absence of a receptacle.

This prevents the endpiece being damaged by the receptacle when the receptacle is put into place on the moving member.

Preferably, the moving member is returned into an initial position by resilient return means.

The friction between the endpiece and the filling valve can be selected in such a manner that the endpiece is clamped sufficiently by the filling valve to retain the receptacle against the return action of the resilient return means.

In other words, the friction between the filling valve and the endpiece holds the moving member down, thereby presenting the advantage of providing the system with structure that is much simpler that that described in above-mentioned U.S. Pat. No. 5,343,904.

Preferably, the moving member is arranged in such a manner as to protect the endpiece in the absence of a receptacle.

In particular, in the absence of a receptacle placed on the moving member, the endpiece does not project beyond it, so that the moving member provides effective protection for the endpiece in the absence of the receptacle.

Advantageously, the apparatus enabling the receptacle to be refilled with compressed air has a detector suitable for detecting that the moving member and arranged to cause the compressor to be switched on when the moving member is down.

Thus, the compressor is set automatically into operation by putting the receptacle into the filling position.

By way of example, the detector can include a microswitch.

In a particular embodiment, the apparatus is arranged in such a manner that the user must hold the moving member down throughout the entire time required for refilling the receptacle.

In which case, as soon as the user releases the receptacle, the moving member rises under the return action of the resilient return means and the endpiece disengages from the valve of the receptacle.

The return of the moving member into its initial position is advantageously detected so that the operation of the compressor is automatically interrupted at that moment.

In a preferred embodiment, the apparatus includes retaining means arranged to hold the moving member down either directly or indirectly against the return action of the resilient return means, so long as a predetermined condition is satisfied, said predetermined condition corresponding, for example, to the pressure inside the receptacle being below a predetermined value and/or to the fact that the compressor is in operation.

In a particular embodiment, the apparatus includes a pressure controller at the outlet from the compressor.

The pressure controller is advantageously used to stop operation of the compressor when the pressure inside the receptacle reaches a predetermined value, corresponding to the end of filling with compressed air.

The above-mentioned retaining means for holding the moving member down throughout the duration of filling advantageously comprise at least one suction cup connected to the inlet of the compressor.

In a particular embodiment, the or each suction cup is positioned in such a manner that the moving member comes into contact therewith when it is pushed down.

So long as the compressor is in operation, the or each suction cup can thus participate in holding the moving member in its down position, due to the suction that exists at the inlet to the compressor.

When the pressure in the receptacle reaches a predetermined value, corresponding to the end of the receptacle being filled with compressed air, the operation of the compressor is interrupted.

The partial vacuum that exists at the inlet to the compressor ceases, such that the adhesion of the or each suction cup on the moving member also ceases and the moving member can return to its initial position under the return action of the resilient return means.

The return movement of the moving member towards its initial position pushes away the receptacle and the endpiece is disengaged from the valve.

In another particular embodiment, the or each suction cup comes into contact with the receptacle when the moving member is pushed down. The moving member then advantageously includes openings enabling the or each suction cup to come into contact with the bottom of the receptacle when the receptacle is standing on the moving member and the moving member is down.

Thus, the moving member is held down against the action of the resilient return means by the or each suction cup adhering to the receptacle, due to the suction that exists at the inlet to the compressor while the compressor is in operation.

If the receptacle is withdrawn, the moving member rises under the effect of the resilient return means.

This upward movement of the moving member is advantageously detected so as to interrupt operation of the compressor.

Advantageously, the apparatus has three suction cups that are uniformly distributed angularly around the endpiece.

In a particular embodiment, the compressor is connected by a pipe to an air intake which is arranged in such a manner as to give rise to head loss.

Advantageously, said head loss is selected so that the suction existing at the inlet of the compressor is strong enough to enable the suction cup(s) to exert the desired force on the moving member or the receptacle.

When the bottom of the receptacle is outwardly concave, the top surface of the moving member advantageously presents a dome arranged to favor proper positioning of the receptacle relative to the moving member.

BRIEF DESCRIPTION OF THE DRAWINGS

The invention will be better understood on reading the following detailed description of non-limiting embodiments and on examining the accompanying drawings, in which.

MORE DETAILED DESCRIPTION

Figure 1:
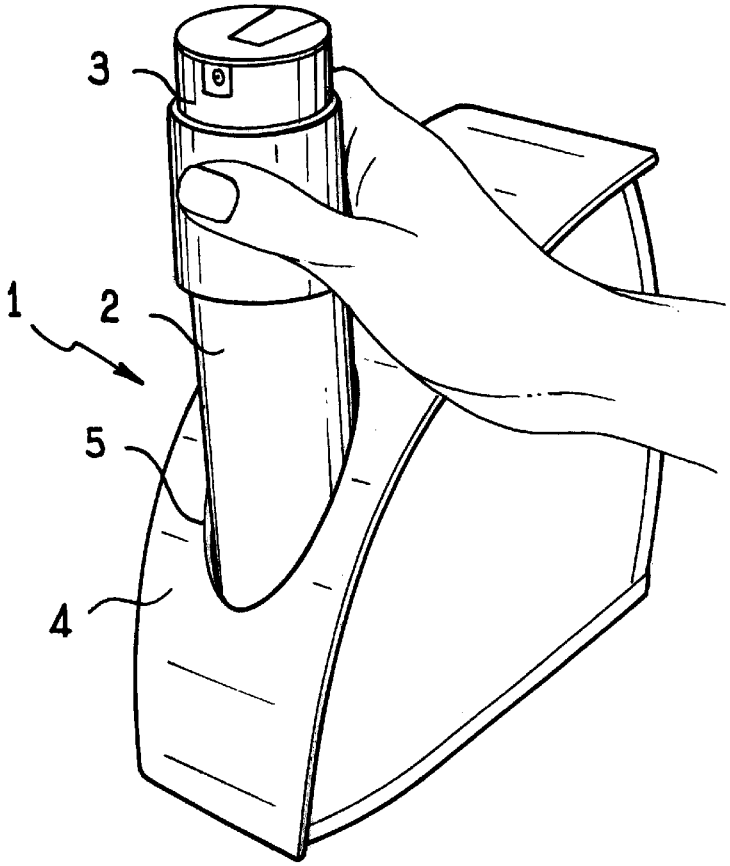
FIG. 1 is a diagrammatic perspective view showing a system constituting an embodiment of the invention, with an aerosol receptacle being filled by apparatus for refilling it with compressed air.
Figure 3:
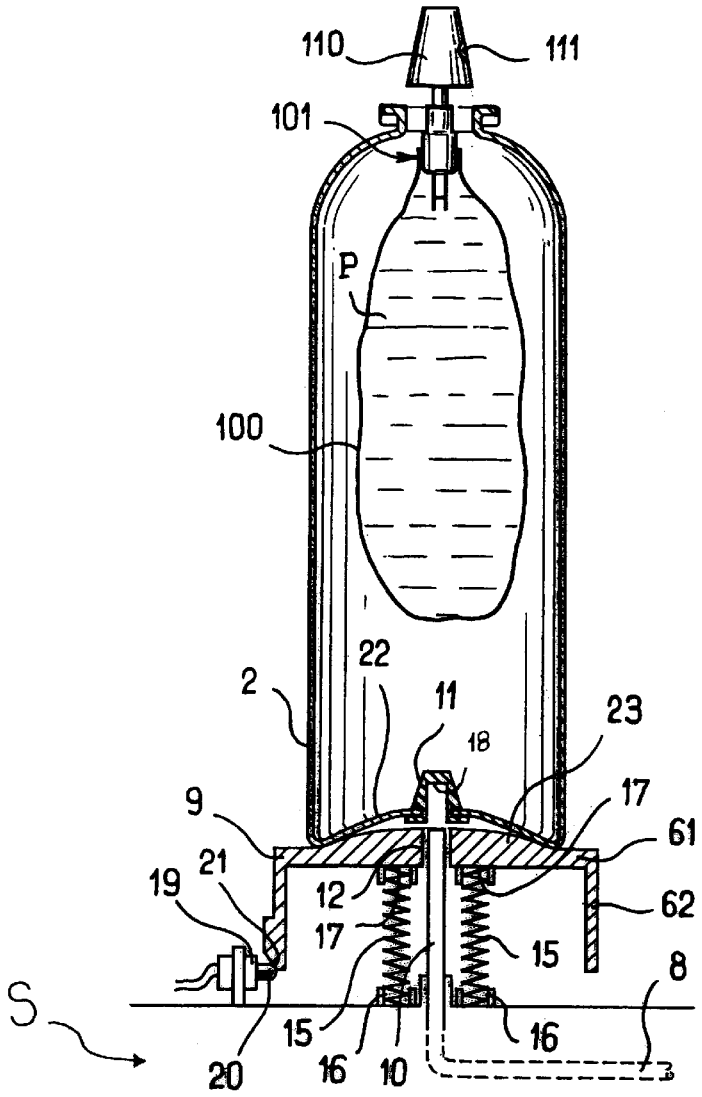
FIG. 3 is a fragmentary diagrammatic section view of the apparatus shown in FIGS. 1 and 2, with the receptacle placed on the moving member.

FIG. 1 shows apparatus 1 enabling a receptacle 2 to be refilled, the receptacle comprising a tank provided on top with a dispenser head 3 and at the bottom with filling valve 11 having an end wall 18, that is not visible in FIG. 1 but that is shown in FIG. 3.

The valve 11 is known per se and has a slot capable of opening under air pressure during refilling. Preferably the filling valve 11 is made solely out of elastomer, preferably by molding in a single piece. This presents a structure that is less complex than filling valves of known dispensing systems.

Figure 3A:
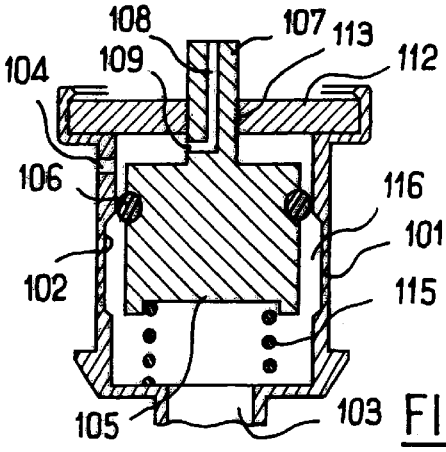
FIGS. 3A and 3B are diagrammatic axial sections showing the valve of the receptacle in isolation.
Figure 3B:
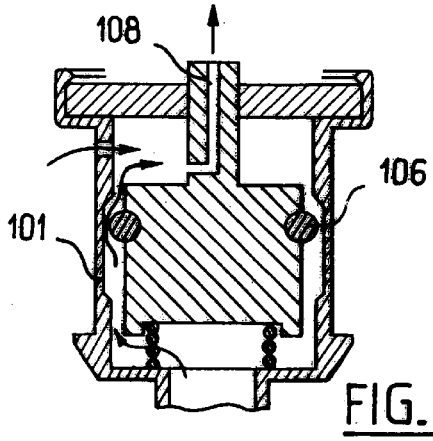

The bag 100 is fixed to a valve 101 that is shown in FIGS. 3A and 3B.

The valve 101 advantageously has three positions, e.g. being identical to the valve described in European patent application EP 0 709 305 A1.

This valve comprises a body 102 provided at its bottom end with an opening 103 communicating with the inside of the bag 100 and at its top with a passage 104 for admitting gas.

The valve 101 also has a moving member 105 carrying an O-ring 106, extended at its top by a control rod 107 provided with an internal duct 108, the duct opening out sideways at its bottom end via an orifice 109 into the inside of the body 102 when the user presses on the pushbutton 110, which pushbutton has a dispensing nozzle 111.

The valve 101 also has a gasket 112 pierced by an orifice 113 through which the control rod 107 passes and suitable for closing the orifice 109 when the valve is at rest.

The moving member 105 is urged into a high position by a spring 115.

When the valve is at rest, the orifice 109 is closed by the gasket 112.

The body 102 has an annular groove 116 in its inside surface.

When the user presses on the pushbutton 110, the moving member 105 moves down against the return action of the spring 115 and the orifice 109 opens out beneath the gasket 112 into the inside of the body 102.

Propellant gas can then pass through the passage 104 and into the duct 108.

The O-ring 106 bears in leakproof manner against the inside surface of the body 102 and prevents the liquid being entrained by the propellant gas.

When the user pushes the control rod 107 down further, the O-ring 106 ceases to bear against the inside surface of the body and the liquid can pass around the moving member 105 and mix with the propellant gas so as to reach the duct 108.

The valve described with reference to FIGS. 3A and 3B presents the advantage of enabling the dispensing circuit to be purged when the user releases the pushbutton, and thus avoiding the liquid drying out and blocking it.

A more conventional valve could equally well be used.

The apparatus 1 comprises a case with a cover 4 having an opening 5 into which the receptacle 2 is inserted.

Figure 2:
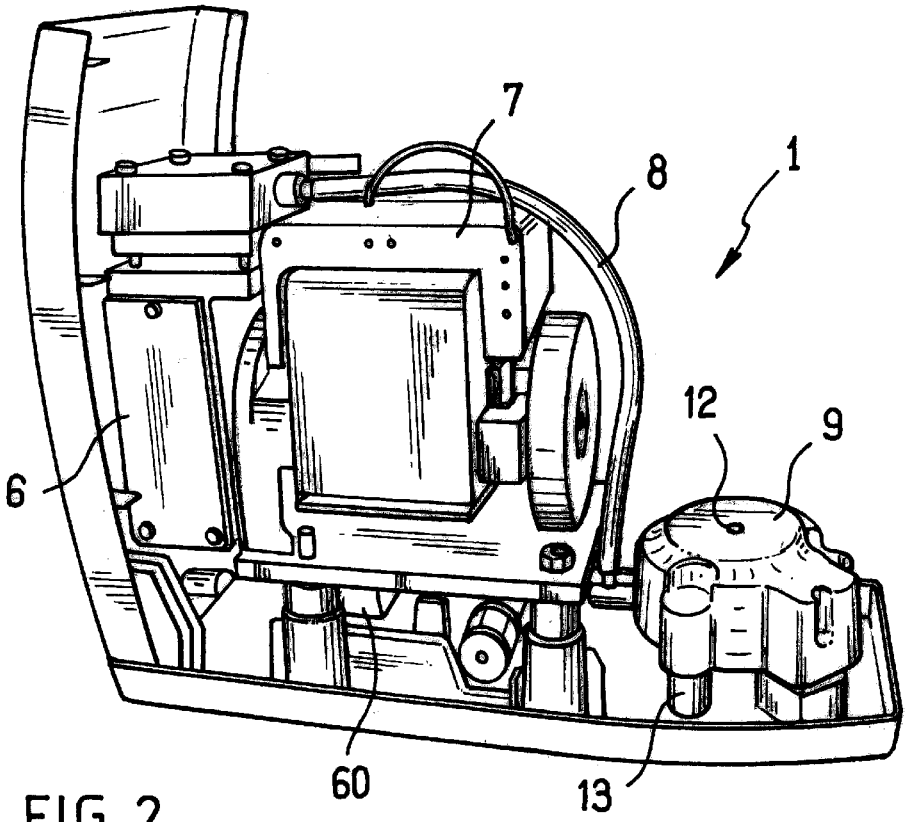
FIG. 2 is a diagrammatic perspective view of the FIG. 1 apparatus with the cover removed.

FIG. 2 shows the apparatus 1 after its cover 4 has been removed.

This figure shows a compressor 6 driven by an electric motor 7.

The outlet 13 from the compressor is connected via a pressure controller 60 and a hose 8 to a fixed filling endpiece 10 shown in FIG. 3 and protected by a moving member 9 in the absence of a receptacle 2.

The moving member 9 is designed to receive the receptacle 2 and comprises a top platform 61 that is extended downwards at its periphery by a tubular skirt 62.

The platform 61 has a central through hole 12 through which the endpiece 10 can pass.

In the embodiment described, the bottom 22 of the receptacle 2 is outwardly concave and the platform 61 has an upwardly directed domed surface 23.

The dome 23 is designed to co-operate with the bottom 22 of the receptacle 2 in such a manner that the valve 11 takes up a position on the axis of the endpiece 10 when the receptacle 2 is put into place.

The moving member 9 can be moved vertically along the axis of the endpiece 10 while being guided by guide means 13. These guide means 13 are not shown in FIG. 3 in order to clarify the drawing, and they comprise guides formed in the bottom of the case of the apparatus 1 and cylindrical housings integrally formed with the tubular skirt 62 of the moving member 9 as a single molding of plastics material.

Resilient return means are provided to urge the moving member 9 into a high position in the absence of a receptacle 2.

In the example described, these resilient return means are constituted by helical compression springs 15 received at their bottom ends in the housings 16 made in the bottom of a support case S of the apparatus 1 and at their top ends in housings 17 made in the bottom face of the platform 62 of the moving member 9.

A microswitch 19 is provided to detect when the moving member 9 is in its down position.

The microswitch 19 has a moving feeler 20 and the moving member 9 has a ramp 21 arranged so that downward movement of the moving member 9 causes the feeler 20 to be pushed in, thereby closing the electrical contact of the microswitch 19.

The microswitch 19 causes the electric motor 7 driving the compressor 6 to be switched on.

In the absence of a receptacle 2, the endpiece 10 is protected by the moving member 9 as can be seen in FIGS. 2 and 3, and it remains engaged in the moving member 9 so that the top end of the endpiece 10 is flush with the top surface of the moving member 9.

To refill the receptacle 2, the user inserts it in the apparatus i through the opening 5 in the cover 4 until the bottom of the receptacle 2 comes to bear against the dome 23 of the moving member 9.

The stiffness of the springs 15 is selected so that the weight of the receptacle 2 on its own is insufficient to cause the moving member 9 to move down far enough to cause the microswitch 19 to close and the endpiece 10 to engage in the valve 11.

It is thus necessary for the user to push downwards in order to compress the spring 15 and cause the moving member 9 to be pushed down far enough for the endpiece 10 to engage in the valve 11 and for the electrical contact of the microswitch 19 to close.

The compressor 6 delivers compressed air to the endpiece 10 and the valve 11 opens under the pressure of the air.

The pressure controller 60 switches off the electrical power supply to the motor 7 driving the compressor 6 when a predetermined pressure is reached at the outlet 13 of the compressor.

The user can then remove the receptacle 2.

As it is being removed, the springs 15 return the moving member 9 to its high position.

The friction between the endpiece 10 and the valve 11 in the example described is sufficient to hold the receptacle 2 in place against the action of the springs 15 while it is being filled.

Thus, the user does not need to press the receptacle down throughout the time taken to fill it, nor after it has been filled, if the receptacle is left in place.

If the receptacle is left in place, the endpiece is in contact only with air contained inside the receptacle, and not with the liquid, so there is no risk of leakage or of the endpiece corroding.

In a variant, the friction between the endpiece 10 and the valve 11 is not sufficient to retain the endpiece 10 in the valve 11 if the receptacle is released, which means that the user is then obliged to keep on pressing down on the receptacle 2 so long as filling is taking place.

Figure 4:
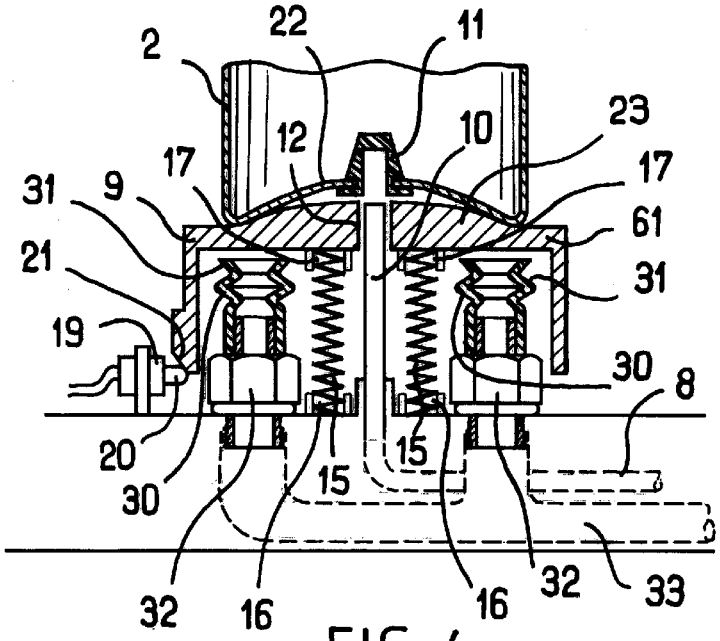
FIG. 4 is a fragmentary diagrammatic section view of a first variant embodiment of the apparatus, the moving member being shown in the up position.

The embodiment shown in FIG. 4 differs from the preceding embodiment in that retaining means are provided to retain the moving member 9 in its low position while the receptacle 2 is being filled.

In the embodiment of FIG. 4, these retaining means comprise three suction cups 30 that are uniformly distributed angularly around the endpiece 10.

Only two of the three suction cups can be seen in FIG. 4.

Each suction cup 30 has a top bellows 31 made of elastomer material, said bellows 31 being connected at its bottom end to a fixed and threaded endpiece 32 that is connected to a pipe 33.

Figure 5:
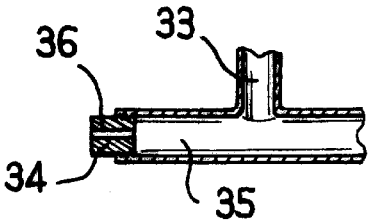
FIG. 5 shows the air intake of the compressor.

As shown in FIG. 5, the inlet of the compressor 6 is connected to an air intake 36 via a pipe 35.

The pipe 33 to which the suction cups 30 are connected is itself connected to the pipe 35 downstream from the air intake 36.

The air intake 36 is constituted by an orifice through a plug 34, and the diameter of the orifice is selected in such a manner as to create sufficient head loss to enable the pipe 35 to be act a suitable suction while the compressor 6 is in operation.

This suction enables the suction cup 30 to hold onto plane regions of the inside face 37 of the platform 61 of the moving member 9.

To fill the receptacle 2, the user places the receptacle on the moving member 9, as shown in FIG. 4 and then pushes downwards.

This causes the moving member 9 to be moved downwards and brings the bottom face 37 of the platform 61 of the moving member 9 into contact with the bellows 31 of the suction cups 30.

Having the moving member 9 in its down position also enables the endpiece 10 to engage in the valve 11 and also causes the electrical contact of the microswitch 19 to close.

The compressor 6 is put into operation and suction appears in the pipes 33 and 35.

This suction keeps the bellows 31 retracted and adhering to the inside face 37 of the moving member 9.

The bellows 31 thus holds the moving member 9 against the return force of the springs 15, so the user can release the receptacle 2 without that causing the moving member 9 to rise.

When the pressure in the receptacle 2 reaches a predetermined value, the pressure controller 60 interrupts operation of the compressor 6, so the pipes 33 and 35 return to ambient pressure.

The suction cups 30 then cease to hold onto the moving member 9 and to retain it, thus allowing it to rise under the return force of the springs 15.

This upward movement causes the endpiece 10 to be disengaged from the valve 11 of the receptacle 2.

Figure 6:
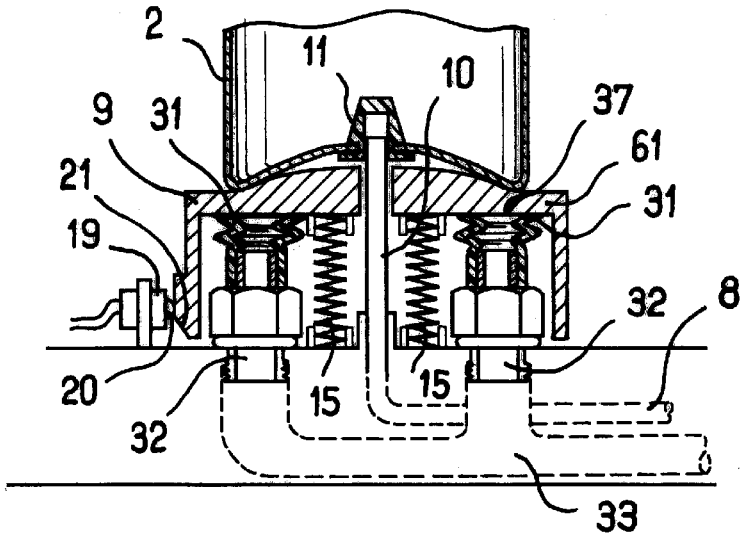
FIG. 6 is a view analogous to FIG. 4, after the moving member has been pushed down.

The embodiment shown in FIGS. 4 to 6 suffers from the following drawback.

If the receptacle 2 is withdrawn while the compressor is in operation, then the compressor continues to operate since the suction cups 30 hold the moving member 9 down so the electrical contact of the microswitch 19 is kept closed.

Figure 7:
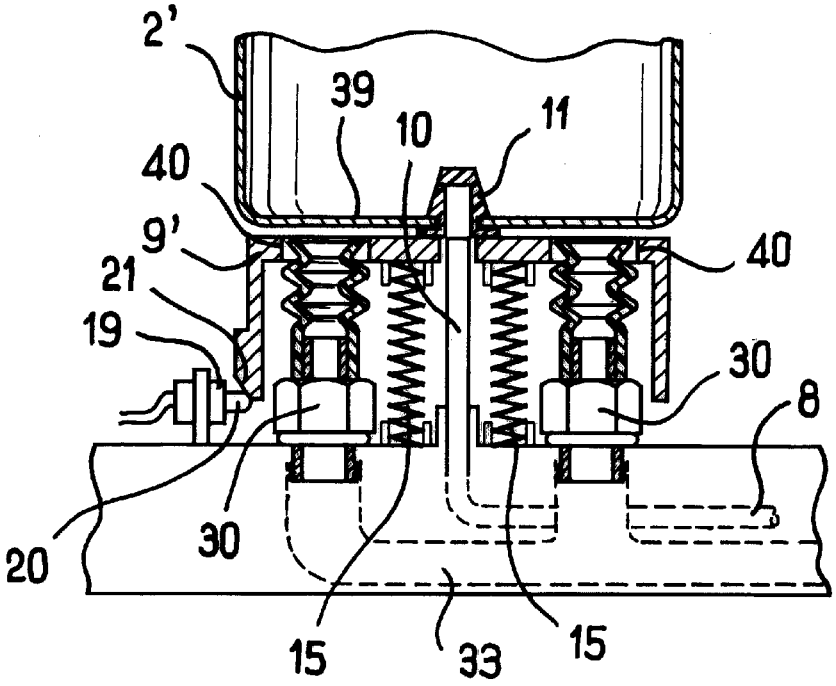
FIG. 7 is a fragmentary diagrammatic view showing a second variant embodiment of the apparatus, the moving member being shown in the up position.
Figure 8:
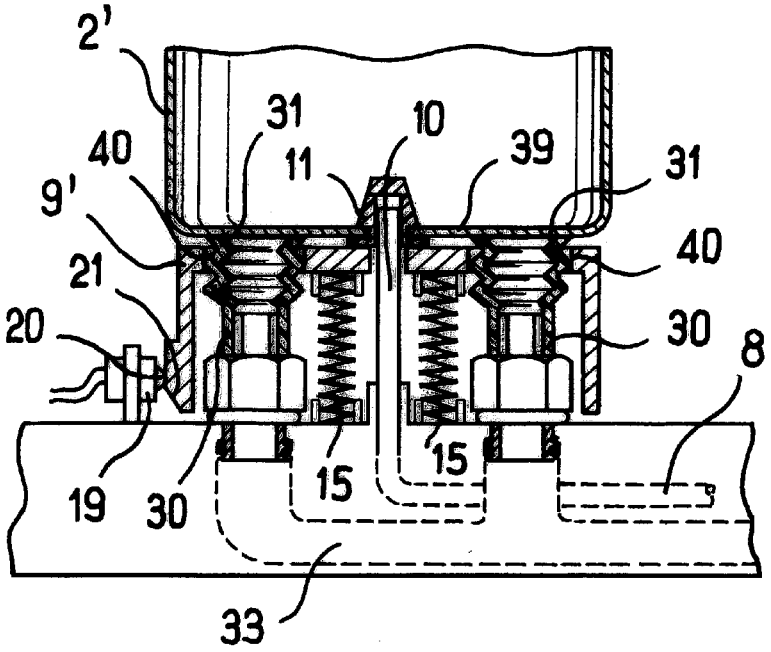
FIG. 8 is a view analogous to FIG. 7, after the moving member has been pushed down.

The embodiment shown in FIGS. 7 and 8 enables this drawback to be remedied.

In these figures, a receptacle 2' is shown with a flat bottom 39 and a moving member 9' is shown that differs from the above-described moving member 9 in that it does not have a dome 23 and in that it has a hole 40 over each of the suction cups 30 so as to enable the suction cups to come directly into contact with the bottom 39 of the receptacle 2' when the moving member 9' is pushed down.

When the receptacle 2' is put into place on the moving member 9' and is pushed down, the moving member 9' moves downwards, the endpiece 10 engages in the valve 11, and the feeler 20 of the microswitch 19 is moved, thereby causing the compressor to be switched on.

The bellows 31 of the suction cups 30 extend through the holes 40 and engage the bottom 39 of the receptacle 2', so the suction which is established in the pipe 33 when the compressor is in operation serves to hold the bellows 31 retracted and adhering to the bottom 39 of the receptacle 2'.

The moving member 9' is thus held in the down position against the return force of the springs 15.

When sufficient pressure is reached inside the aerosol receptacle 2', the pressure controller 60 at the outlet of the compressor switches it off and the suction in the pipe 33 ceases.

The bellows 31 return to their initial shape and the moving member 9' rises under the return force of the springs 15.

The upward movement of the moving member 9' causes the endpiece 10 to become disengaged from the valve 11.

It is the receptacle 2' that holds the moving member 9' down while the receptacle is being filled.

The receptacle 2' is itself held down by the suction cups 30.

If the user withdraws the receptacle 2' while it is being filled and in spite of the adherence of the suction cups 30, the moving member 9' is free to rise under the return force of the spring 15, thereby opening the electrical contact of the microswitch 19 and switching off the compressor.

Naturally, the invention is not limited to the embodiments described above.

In particular, retaining means other than suction cups can be used for holding the moving member down while the aerosol receptacle is being filled.

In a variant that is not shown, an electromagnetic latch is used that is capable of holding the moving member down during filling.

In another variant that is not shown, a pneumatic latch is used that is controlled by the suction at the inlet to the compressor.

What is claimed is:

1. A system for dispensing a fluid using a receptacle and refilling the receptacle with compressed air, comprising:

a receptacle provided with a filling valve, said receptacle being suitable for containing the fluid to be dispensed and compressed air, the fluid and the compressed air being contained in different spaces, and an apparatus for refilling the receptacle with compressed air, said apparatus comprising:

a member for receiving said receptacle at least during refilling of said receptacle, said member being movable under an effort manually between an upper position and a lower position, an endpiece for refilling said receptacle with compressed air through said filling valve, and a compressor including a pressure controller at an outlet of the compressor, wherein said member is provided with a passage for the endpiece, the member and the endpiece being arranged in such a manner that the endpiece engages in the filling valve of the receptacle in response to the member being pushed down.

2. A system according to claim 1, wherein the fluid is a liquid contained in a flexible bag inside the receptacle.

3. A system according to claim 1, wherein the receptacle is provided with a valve enabling the liquid to be dispensed, said valve having at least three functionally different positions, namely:

a rest position;

a position enabling air to be dispensed on its own; and a position enabling a mixture of air and liquid to be dispensed.

4. A system according to claim 1, wherein the filling valve is made solely out of elastomer.

5. A system according to claim 1, wherein the apparatus enabling the receptacle to be refilled with compressed air comprises a compressor, said endpiece being connected to an outlet of the compressor and arranged so as to engage in the filling valve of the receptacle.

6. A system according to claim 1, in which the filling valve has an end wall, wherein the endpiece has a length selected so that it does not reach the end wall of the filling valve when the member is pushed down.

7. A system according to claim 1, wherein the endpiece remains engaged in the member whatever position of the member.

8. A system according to claim 7, wherein the member is arranged in such a manner as to protect the endpiece in an absence a receptacle.

9. A system according to claim 1, wherein, in an absence of the receptacle placed on the moving member, the endpiece does not project beyond the member.

10. A system according to claim 1, wherein the apparatus enabling the receptacle to be refilled with compressed air has a compressor and a detector, the detector suitable for detecting that the member is moving down and arranged to cause of compressor to be switched on when the member is down.

11. A system according to claim 10, wherein the detector includes a microswitch.

12. A system according to claim 1, wherein the apparatus enabling the receptacle to be refilled with compressed air is arranged in such a manner that an user must keep the member down throughout an entire length of time necessary for refilling the receptacle.

13. A system according to claim 1, wherein the member is returned into an initial position by resilient return means.

14. A system according to claim 13, wherein the apparatus enabling the receptacle to be refilled with compressed air includes retaining means arranged to keep the member down either directly or indirectly against the return force of the resilient return means, so long as a predetermined condition is satisfied.

15. A system according to claim 14, wherein said predetermined condition corresponds to the existence of pressure below a predetermined value inside the receptacle.

16. A system according to claim 14, wherein said predetermined condition corresponds to the fact that the compressor is in operation.

17. A system according to claim 14, wherein said retaining means comprise at least one suction cup connected to an inlet of the compressor.

18. A system according to claim 17, wherein each suction cup is positioned in such a manner that the member comes into contact therewith when it is down.

19. A system according to claim 17, wherein the at least one suction cup comes into contact with the receptacle when the member is pushed down.

20. A system according to claim 19, wherein the member has openings allowing the at least one suction cup to come into contact with the bottom of the receptacle when the receptacle is standing on the member and the member is pushed down.

21. A system according to claim 17, including three suction cups uniformly distributed angularly around the endpiece.

22. A system according to claim 17, wherein the compressor is connected by a pipe to an air intake which is arranged in such a manner as to give rise to head loss.

23. A system according to claim 22, wherein said head loss is selected so that the suction existing at the inlet of the compressor is strong enough to enable the at least one suction cup to exert the desired force on the member or the receptacle.

24. A system according to claim 13, wherein said endpiece and said filling valve are suitable for cooperating with friction, and wherein the friction between the endpiece and the filling valve is selected in such a manner that the endpiece is held sufficiently tightly by the filling valve to retain the receptacle against a return force of the resilient return means.

25. A system according to claim 1, said receptacle having a pressure therein, wherein said pressure controller stops operation of the compressor when the pressure inside the receptacle reaches a predetermined value, corresponding to an end of filling with compressed air.

26. A system according to claim 1, said receptacle having a bottom, wherein the bottom of the receptacle is outwardly concave, and wherein the member has a dome arranged to encourage proper positioning of the receptacle relative to the member.

27. A system according to claim 1, wherein the filling valve is made of an integrally molded piece.

28. A system according to claim 1, comprising a support receiving the apparatus at least during refilling of said receptacle, wherein said endpiece is fixed relative to said support and wherein said member is movable relative to said support.

29. A system for dispensing a fluid using a receptacle and refilling the receptacle with compressed air, comprising:

a receptacle having an outwardly concave bottom and provided with a filling valve, said receptacle being suitable for containing the fluid to be dispensed and compressed air in different spaces; and an apparatus for refilling the receptacle with compressed air through said filling valve, comprising:

a member having an upwardly directed dome surface suitable for cooperating with the bottom of the receptacle during refilling of said receptacle, said member being movable between an upper position and a lower position, and an endpiece for refilling said receptacle with compressed air, wherein said member is provided with a passage for the endpiece, the member and the endpiece being arranged in such a manner that the endpiece engages in the filling valve of the receptacle in response to the member being pushed down.

30. A system according to claim 29, wherein the endpiece remains engaged in the member whatever the position of the member.

31. A system according to claim 29, wherein the member is arranged in such a manner as to protect the endpiece in an absence a receptacle.

32. A system according to claim 29, wherein, in an absence of a receptacle placed on the member, the endpiece does not project beyond the member.

33. A system according to claim 29, wherein the fluid is a liquid contained in a flexible bag inside the receptacle.

34. A system for dispensing a fluid using a receptacle and refilling the receptacle with compressed air, comprising:

a receptacle comprising an integrally made filling valve at a bottom of the receptacle, said receptacle being suitable for containing the fluid to be dispensed and compressed air in different spaces; and an apparatus for refilling the receptacle with compressed air comprising a member for receiving said receptacle at least during refilling of said receptacle, said member being movable between an upper position and a lower position.

35. A system according to claim 34, wherein the fluid is a liquid contained in a flexible bag inside the receptacle.

36. A system according to claim 34, wherein the filling valve is made solely out of elastomer.

37. A system according to claim 34, wherein the receptacle is provided with a valve enabling the fluid to be dispensed, said valve having at least three functionally different positions, namely:

a rest position;

a position enabling air to be dispensed on its own; and a position enabling a mixture of air and fluid to be dispensed.

38. A system for dispensing a fluid using a receptacle and refilling the receptacle with compressed air, comprising:

a receptacle suitable for containing the fluid to be dispensed and compressed air, the fluid and the compressed air being contained in different spaces, comprising:

a filling valve, and a dispensing valve enabling the liquid to be dispensed, said valve having at least three functionally different positions, namely:

a rest position;

a position enabling air to be dispensed on its own; and a position enabling a mixture of air and liquid to be dispensed, and an apparatus for refilling the receptacle with compressed air through said filling valve, comprising:

a member for receiving said receptacle at least during refilling of said receptacle, said member being movable between an upper position and a lower position, and an endpiece for refilling said receptacle with compressed air, wherein said member is provided with a passage for the endpiece, the member and the endpiece being arranged in such a manner that the endpiece engages in the filling valve of the receptacle in response to the member being pushed down.

39. A system according to claim 38, wherein said filling valve is made out of one piece.

40. A system according to claim 38, wherein the endpiece remains engaged in the member whatever the position of the member.

41. A system according to claim 38, wherein the member is arranged in such a manner as to protect the endpiece in an absence of a receptacle.

42. A system according to claim 38, wherein, in an absence of a receptacle placed on the member, the endpiece does not project beyond the member.

43. A system according to claim 38, wherein the fluid is a liquid contained in a flexible bag inside the receptacle.

44. A system for dispensing a fluid using a receptacle and refilling the receptacle with compressed air, comprising: p1 a receptacle provided with an externally accessible filling valve, said filling valve having an end wall, said receptacle being suitable for containing the fluid to be dispensed and compressed air, the fluid and the compressed air being contained in different spaces, and an apparatus for refilling the receptacle with compressed air, said apparatus comprising:

an endpiece for refilling said receptacle with compressed air through said filling valve, and a member for receiving said receptacle at least during refilling of said receptacle, said member being provided with a passage for the endpiece, the member and the endpiece being arranged in such a manner that the endpiece engages in the filling valve of the receptacle without reaching the end wall of the filling valve in response to the member being pushed down.

45. A system according to claim 44, wherein said filling valve is made out of one piece.

46. A system according to claim 44, wherein the member is arranged in such a manner as to protect the endpiece in an absence of a receptacle.

47. A system according to claim 44, wherein, in an absence of a receptacle placed on the member, the endpiece does not project beyond the member.

48. A system according to claim 44, wherein the fluid is a liquid contained in a flexible bag inside the receptacle.

* * * * *